United States Patent [19]

McLaren

[11] 4,277,242

[45] Jul. 7, 1981

[54] IONIZING RADIATION TREATMENT OF WOOL TEXTILES WITH RESIN FOR SHRINK RESISTANCE

[75] Inventor: Keith G. McLaren, Beverly Hills, Australia

[73] Assignee: Australian Atomic Energy Commision, Coogee, Australia

[21] Appl. No.: 870,299

[22] Filed: Jan. 18, 1978

[30] Foreign Application Priority Data

Feb. 7, 1977 [AU] Australia ..... PC8975

[51] Int. Cl.[3] ..... D06M 3/02; D06M 13/00

[52] U.S. Cl. ..... 8/128 A; 8/127.6; 8/DIG. 11; 8/DIG. 12; 8/DIG. 18

[58] Field of Search ..... 8/DIG. 12, DIG. 18, 8/128 A, 2, 127.6, DIG. 11

[56] References Cited

U.S. PATENT DOCUMENTS

| | | | |
|---|---|---|---|
| 3,098,572 | 7/1978 | Smith | 8/128 A |
| 3,461,052 | 8/1969 | Restaino et al. | 204/159.12 |
| 3,676,057 | 7/1972 | Brown | 8/128 A |
| 3,832,228 | 8/1974 | Gardiner et al. | 8/128 A |
| 3,870,556 | 3/1975 | Noll et al. | 8/127.6 |
| 3,898,197 | 8/1975 | Guise et al. | 8/128 A |
| 3,927,961 | 12/1975 | Simpson | 8/17 |
| 3,989,458 | 11/1976 | Guise | 8/128 A |

FOREIGN PATENT DOCUMENTS

| | | | |
|---|---|---|---|
| 2228137 | 1/1973 | Fed. Rep. of Germany | 8/DIG. 12 |
| 7205532 | 10/1972 | Netherlands | 8/128 A |
| 834557 | 5/1960 | United Kingdom . | |
| 1263294 | 2/1972 | United Kingdom . | |

OTHER PUBLICATIONS

American Dyestuff Reporter, May 10, 1965, pp. 64–68.

Alexander and Hudson, "Wool: Its Chemistry and Physics" (Reinhold), 1954, pp. 331–332.

Whitfield et al., Textile Research Journal, Mar. 1965, pp. 237–241.

*Primary Examiner*—A. Lionel Clingman

*Attorney, Agent, or Firm*—Ladas & Parry

[57] ABSTRACT

Shrink-resistance is provided in a wool textile by applying ionizing radiation and a polymer resin (or mixture of resins) selected such that the resin will be bonded onto the wool fibres and form a relatively thin application, the process being carried out substantially at ambient temperature. The radiation step may be a preliminary step followed by the fixing of polymer resin or polymer resin mixture onto the wool in the absence of catalysts or alternatively the polymer resin may be applied before the radiation process. The polymer resin may be just one resin selected from a group of known resins having a shrink-resistant effect on wool textiles when fixed thereto by prior art techniques, or a mixture of such known resins may be used.

10 Claims, No Drawings

IONIZING RADIATION TREATMENT OF WOOL TEXTILES WITH RESIN FOR SHRINK RESISTANCE

FIELD OF THE INVENTION

The present invention relates to the treatment of "wool textiles" which is hereby defined as a textile in which at least a proportion of the fibres are of wool. The invention is especially applicable to textiles which are entirely of wool, but the invention may also find useful application to blended textiles, particularly where a majority of the fibre content is wool.

BACKGROUND OF THE INVENTION

Wool is a widely used fibre particularly in the clothing industry, but limitations on the properties of wool textiles have resulted in considerable research in the past with a view to improving wool textiles, for example with respect to improving resistance to soiling, creasing and importantly shrinking. A stimulus to this research has been the market demand for 100% wool garments which are washable and need a minimum of ironing. According to the prior art, such woollen garments can only be made by combining a shrinkproofing treatment with a permanent setting treatment.

Techniques have been published for shrinkproofing wool textiles by the application of preformed polymer resins. These techniques rely on the use of catalysts and usually elevated temperatures in order to bring about insolubilisation and fixation of the resin to the wool. This is disadvantageous as well as inconvenient from a manufacturing point of view.

Typically, curing of the polymer resin under the influence of the catalyst will require temperatures in the range of 80° C. to 150° C., and this technique can result in significant loss of strength of the textile, considerable cost and inconvenience of having to remove residual catalyst after the curing process, the development of unpleasant odours and fumes, and contamination and corrosion of equipment.

Despite these disadvantages, the acute need for an effective shrinkproofing process for wool textiles has resulted in the commercial application of polymer treatments using thermal/catalytic curing. A range of commercial polymer resins has been developed and these resins have been used despite the inherent disadvantages and difficulties in using such resins.

To be acceptable the resin must leave the textile with the desirable feel and "hand" and in general, soft polymers with a flexible "backbone" have been preferred. Furthermore, a thin film of polymer is all that is desired on the wool fibres in order to cause only a small increase in weight of the textile and to avoid imparting stiffness.

In the prior art, the use of high temperatures for curing textile resins has been accepted as necessary in order to speed up the curing reactions by expelling volatile reaction products (e.g. water, formaldehyde, alcohols), or by inducing the desired activity in the catalysts, many of which are only "latent" catalysts which are ineffective at low (ambient) temperatures.

The applicants have investigated the question of curing resins of the type referred to above at ambient temperature using ionising radiation, but it does not appear that such polymer resins are amenable to radiation curing techniques per se. Ionizing radiation may be defined as radiation having sufficient energy to create ion pairs by displacing electrons from atoms, i.e. at least about 32 electron volts, and this includes electromagnetic radiation (X-rays and gamma-rays) and particle radiation (especially electrons).

In another prior art proposal, it has been demonstrated that certain monomers, usually of the vinyl unsaturated type, can be applied to textiles and that ionising radiation can be used to initiate chain polymerisation reactions. It is to be noted that the technical problems and characteristics of monomers are quite different from that which will be found in the technology associated with preformed polymers. Potentially such a process has the advantage of obviating the use of activating agents and catalysts which require subsequent removal. However, such monomer-polymerisation reactions have not conferred shrink-resistance, and no practical processes using such methods have been demonstrated.

SUMMARY OF THE INVENTION

The present invention is concerned with providing a process which will facilitate convenient and economic processing of wool textiles, and at least in some embodiments there can be provided advantages such as reduced atmospheric pollution and lower energy consumption compared with known thermal curing processes. Embodiments of the invention can be useful for imparting shrink-resistant properties to wool textiles and in this specification the term "shrink-resistant" or the term "shrinkproofing" refers to avoiding to a substantial extent the degree of shrinkage which would otherwise occur if the untreated textile were laundered in a normal manner such as by machine washing.

In this specification, the term "polymer resin" means a liquid polymeric material and includes copolymers and mixtures of homo-polymers and co-polymers, and includes polymer resin mixtures.

According to one aspect of the present invention, there is provided a method of treating a wool textile for imparting shrink-resistant properties, the method comprising applying to the textile ionising radiation and a polymer resin selected such that the resin will be bonded onto the wool fibres and form a relatively thin application thereon for imparting shrink-resistant properties, the process being carried out at ambient temperature.

Conveniently, the polymer resin is selected from the group of commercially available resins which are known to impart shrink-resistant characteristics on wool textiles without adversely affecting their properties such as stiffness, weight and hand. Details of such resins will be given hereinafter. However, it is to be noted that these resins are to be used without the inclusion of their catalysts which are essential under the prior art proposals, and the fixation process is effected at ambient temperature rather than the elevated temperature required in the past. Although these commercial resins are currently the best resins for use in practising the present invention, other polymer resins may be located or developed and could equally be useful in practicing the present invention provided they can be fixed to wool textiles according to the method stated above with the resin being in the liquid phase, i.e. emulsion, solution or suspension.

Use of the invention can avoid the problems of high temperature curing which can damage the strength of the wool fibres, and can avoid the expensive and inconvenient steps of neutralisation and removal of catalyst residues. Furthermore it is easy to control the nature and dose of the ionising radiation to suit the particular wool textile and the particular type of process (i.e. batch or continuous operation), and the effect of the radiation can be closely monitored.

The invention can be applied by exposing the wool textile to ionising radiation either before or after the polymer resin is applied. It is believed that ionising radiation causes both chemical and physical changes in the structure of wool fibres, whereby the wool becomes more reactive, especially in the surface layers. In addition, reactive species such as ions, free radicals or excited species are believed to be generated throughout the wool fibre and these can remain trapped in the wool fibre (and be potentially reactive) for finite times, depending on the environment to which the irradiated wool is exposed. However ionizing radiation alone does not confer any significant degree of shrink resistance on wool.

The theory given in this specification is to be construed as mere explanation as an aid to understanding what may be the mechanism by which the invention operates, but the applicants are not to be bound by the completeness or correctness of such theory and the theory itself forms no part of the invention to be claimed.

The present invention is based on the surprising and unexpected realisation that many different types of polymer known to be capable of being fixed to wool textiles in the presence of catalysts and elevated temperature and to impart shrink-resistant characteristics can, with potentially much greater convenience and economy, also be fixed to wool textiles without the use of catalysts and elevated temperature simply by using ionising radiation either before or after the polymer resin is applied to the textile. The invention exploits the effects of the ionising radiation, although the mechanism of the effect of the radiation on the wool textile is not fully understood. However, as will be demonstrated hereinafter with reference to specific examples, effective fixing of the polymer resin to the wool textile does occur despite the fact that it appears that the polymer resin alone would not respond effectively to ionising radiation of ambient temperature, especially at the low radiation dose levels typical of embodiments of this invention.

Furthermore, as opposed to the problem of polymerising a monomer by the use of ionising radiation, wherein specially purified monomers are necessary and the problem of inhibition of polymerisation reaction in the presence of scavenger species such as oxygen has to be dealt with, the present invention may be embodied in arrangements in which polymers of commericial purity only are required. The polymers may contain considerable quantities of additives such as surfactants, chemical stabilisers and emulsifying agents but the polymers can in many cases still be firmly bonded to wool textile by the method of the invention in the presence of oxygen. Furthermore, the bonding is sufficiently stable to permit the wool textile to have a good resistance to repeated washing yet only a relatively small radiation dose is all that is required, at least in some embodiments, to cause the polymer to be applied and fixed to the textile.

In some embodiments of the invention it may be advantageous to include typically small amounts of appropriate radiation-sensitising agents. Such agents can reduce the radiation dose requirements and improve the resistance of the treated wool textile to repeated washing.

Preferably the sensitising agents are selected from organic compounds having reactive functional groups capable of initiating cross-linking or grafting reactions with constituents of the polymer resin and of forming bonds with the wool under the influence of ionising radiation.

For example, the sensitising agents may be selected from compounds having functions groups such as ethylenically unsaturated vinyl (either substituted or unsubstituted), allyl, carboxylic acid or ester thereof, hydroxyl, methylol, amine, aldehyde, epoxide, urethane, silanol, siloxanol and silyl.

The preferred sensitising agent should be chosen having regard to its compatibility, i.e. solubility, miscibility, stability of mixture, with the particular polymer resin used and having regard to whether the resin formulation is to be aqueous solution, an aqueous emulsion or an organic solution.

Particularly useful sensitising agents include acrylic acid, acrylamide, N-methylolacrylamide, hydroxyethylmethacrylate, acrylonitrile, ethyl acrylate, glycol dimethacrylate, 2-ethoxyethylmethacrylate, vinyl acetate, divinyl benzene, trimethylolpropane trimethacrylate, low molecular weight polydimethyl siloxanes, low molecular weight unsaturated polyurethane compounds, and low molecular weight polythioether compounds.

When the method is carried out with irradiation of the wool textile before application of the polymer, it seems that the successful fixing would be due to reactions initiated by the active sites or by reactive species trapped in the irradiated wool textile. However, where the invention is applied by first applying the resin to the wool textile and then exposing to radiation, although the reaction mechanism may be somewhat similar, it seems possible that additional effects occur, perhaps due to direct radiation effects in the polymer resin, such as cross-linking or bond scission followed by molecular rearrangements.

Selection of the polymer resin may be from a wide range or resins including those already known to impart shrink-resistant properties to wool textiles when applied thereto by prior art techniques. Examples of such resins are as follows:

(a) an acrylic resin emulsion (for example, resin sold under the trade mark PRIMAL K-3) (Rohm and Haas);

(b) an aqueous solution of a cross-linked polyamideepichlorhydrin polymer (for example, resins sold under the trade marks HERCOSETT 125 or HERCOSETT 57 by Hercules);

(c) an aqueous emulsion of (thiol) terminated polyethers (for example, resin sold under the trade mark OLIGAN 3806 by Ciba-Geigy);

(d) an organic solvent solution of a polyurethane polymer with active isocyanate groups (for example, resin sold under the trade mark SYNTHAPPRET LKF by Bayer);

(e) an organic solvent soluble polysiloxane polymer (for example, resin sold under the trade mark DC109 by Dow Corning);

(f) water-soluble polymers containing isocyanate groups which have been masked by the formation of bisulphite adducts (for example resin sold under the trade mark SYNTHAPPRET 4694 (Bayer).

The selection of the type and dosage of ionising radiation is made with regard to convenience for the particular manufacture. For example, low dose rata gamma radiation could be convenient for a batch process while high dose rate electron radiation would be more suitable for a continuous process.

In determining the optimum conditions for the use of any particular resin, simple tests are appropriate to determine whether or not it is better to irradiate the textile before or after application of the resin, to determine whether or not oxygen should be excluded during the irradiation and polymer resin reaction step, and to determine the appropriate moisture content of the wool during irradiation. Furthermore, the radiation type and the radiation dose can be selected to suit the resin and the textile and all this must be done in the context of what is the appropriate normal commercial pretreatment for the wool and the cloth. A further feature which should receive consideration is whether or not radiation sensitising additives can be advantageously included in resin formulations to facilitate manufacture.

EXAMPLES OF THE INVENTION

Specific examples of the invention are given hereinafter, the examples relating to tests demonstrating the effectiveness of the invention, all the tests being carried out on a comparative basis using specimens made from a standard high shrinkage wool test cloth obtained from the Australian Wool Corporation.

These examples are by way of illustration only and are not to be regarded as limiting the invention in any way.

With regard to the examples of the invention given hereinafter, the following common points should be noted:

(a) With many types of resin already known for imparting shrink-resistant properties in wool, a chemical pretreatment of the textile is required. Generally this is necessary to promote spreading of the resin on the wool and to reduce the amount of resin required to give good shrinkage resistance. For example, chlorination or alcoholic potash treatments are used. Unless otherwise stated in the examples, the standard test cloth was used with no chemical pretreatment. It should be observed that the standard cloth deliberately has a very high shrinkage if untreated and therefore, relatively large amounts of resin were used in the examples and smaller amounts would be appropriate for normal wool textiles.

(b) Immersion of the test cloth in the resin formulation was carried out in open dishes with gentle rubbing to ensure saturation of the cloth.

(c) The cloth was allowed to dry overnight at ambient temperatures then conditioned at 65% relative humidity before weighing to determine the polymer loading.

(d) Irradiation was carried out using either Cobalt-60 gamma radiation or electrons from a 1 MeV Van de Graaff accelerator. It will be noted that in some examples irradiation was carried out immediately after resin treatment while in others the wool textile was irradiated before treatment with resin. Irradiations were carried out either in air or in a nitrogen atmosphere.

(e) Washing was carried out in apparatus comprising a small rotating drum similar to that described in ASTM D462-64. The washing conditions were as follows:

| | |
|---|---|
| Wash liquor: | pH 7 phosphate buffer solution |
| Temperature: | 40° C. |
| Drum speed: | 34 rpm |

-continued

| | |
|---|---|
| Washing Cycle: | 1 hr wash, followed by a 5 minute |

followed by a 5 minute rinse, then a 2 minute rinse. After drying and measurement of specimens, this cycle was repeated as required. Untreated control specimens were included in each load. Results are reported as % Area Shrinkage after 1, 2 and 3 hours washing.

A. EXAMPLES USING POLYMER RESIN FORMULATIONS BASED ON "OLIGAN 3806"

(Ciba-Geigy Australia Limited

The resin sold under the trade mark "OLIGAN 3806" is a nonionic thiol resin available in concentrated emulsion form. The manufacturer's directions for use require the addition of a catalyst (a polyamide amine derivative) and an alkali (soda ash) to the OLIGAN padding liquor, and a drying/curing temperature of 80°–120° C.

The following examples of the invention were effected omitting the soda ash and catalyst recommended by the manufacturer. It was found that with advantage small amounts of radiation sensitising agents could be included.

EXAMPLE 1

| | |
|---|---|
| Resin Formulation: | |
| OLIGAN 3806 (40% concentrate) | 100 ml |
| TERIC GX13 (wetting agent) | 1 g |
| ACRYLIC ACID (sensitiser) | 2.5 ml |
| Water | to 1 liter |
| Chemical Pretreatment: | Nil |
| Resin Loading: | 9.0% w/w |
| Irradiation: | Electron irradiation in air after resin application and air drying at ambient temperature. |
| Radiation Dose: | $0.5 \times 10^6$ rad |

| | Treated | Untreated Control |
|---|---|---|
| % Area Shrinkage after 1 hr washing | 0 | 21 |
| % Area Shrinkage after 2 hr washing | 0 | 54 |
| % Area Shrinkage after 3 hr washing | 0 | 67 |

EXAMPLE 2

| | |
|---|---|
| Resin Formulation: | |
| OLIGAN 3806 (40% concentrate) | 40 ml |
| TERIC GX13 (wetting agent) | 1 g |
| ACRYLIC ACID (Sensitiser) | 1 ml |
| Water | to 1 liter |
| Chemical Pretreatment: | Nil |
| Resin Loading: | 5.4% w/w |
| Irradiation: | Electron irradiation in air after resin application and air drying at ambient temperature. |
| Radiation Dose: | $0.5 \times 10^6$ rad |

| | Treated | Untreated Control |
|---|---|---|
| % Area Shrinkage after 1 hr washing | 0 | 32 |
| % Area Shrinkage after 2 hr washing | 2 | 52 |
| % Area Shrinkage after 3 hr washing | 9 | 67 |

EXAMPLE 3

| | |
|---|---|
| Resin Formulation: | |
| OLIGAN 3806 (40% concentrate) | 100 ml |
| TERIC GX13 (wetting agent) | 1 g |
| Water | to 1 liter |
| Chemical Pretreatment: | Nil |
| Resin Loading: | 8.0% w/w |
| Irradiation: | Electron irradiation in air, following resin application while specimen still wet with resin. |
| Radiation Dose: | $0.5 \times 10^6$ rad |

| | Treated | Untreated Control |
|---|---|---|
| % Area Shrinkage after 1 hr washing | 1.0 | 22 |
| % Area Shrinkage after 2 hr washing | 1.0 | 51 |
| % Area Shrinkage after 3 hr washing | 1.5 | 65 |

EXAMPLE 4

| | |
|---|---|
| Resin Formulation: | As for Example 1. |
| Chemical Pretreatment: | Nil |
| Irradiation: | Electron irradiation in air, followed by treatment with resin solution (in air). |
| Radiation Dose: | $5 \times 10^6$ rad |
| Resin Loading: | 12.5% w/w |

| | Treated | Untreated Control |
|---|---|---|
| % Area Shrinkage after 1 hr washing | 0 | 23 |
| % Area Shrinkage after 2 hr washing | 0 | 54 |
| % Area Shrinkage after 3 hr washing | 0 | 69 |

EXAMPLE 5

| | |
|---|---|
| Resin Formulation: | As for Example 2. |
| Chemical Pretreatment: | Nil |
| Resin Loading: | 5.6% w/w |
| Irradiation: | Electron irradiation in air, followed by treatment with resin solution (in air). |
| Radiation Dose: | $0.5 \times 10^6$ rad |

| | Treated | Untreated Control |
|---|---|---|
| % Area Shrinkage after 1 hr washing | 0.9 | 32 |
| % Area Shrinkage after 2 hr washing | 4 | 52 |
| % Area Shrinkage after 3 hr washing | 9 | 67 |

EXAMPLE 6

| | |
|---|---|
| Resin Formulation: | As for Example 3. |
| Chemical Pretreatment: | Nil |
| Resin Loading: | 3.6% w/w |
| Irradiation: | Electron irradiation in air, following resin application, while specimen still wet with resin. |
| Radiation Dose: | $5 \times 10^6$ rad |

| | Treated | Untreated Control |
|---|---|---|
| % Area Shrinkage after 1 hr washing | 1.9 | 28 |
| % Area Shrinkage after 2 hr washing | 1.9 | 56 |
| % Area Shrinkage after 3 hr washing | 1.9 | 72 |

EXAMPLE 7

| | |
|---|---|
| Resin Formulation: | |

-continued

| | |
|---|---|
| OLIGAN 3806 (40% concentrate) | 40 ml |
| TERIC GX13 (wetting agent) | 1 g |
| N-methylolacrylamide (50% aq.) (Sensitiser) | 2.2 ml |
| Water | to 1 liter |
| Chemical Pretreatment: | Nil |
| Resin Loading: | 3.9% w/w |
| Irradiation: | Gamma radiation (in nitrogen), after resin application and air drying at ambient temperature. |
| Radiation Dose: | $5 \times 10^6$ rad |

| | Treated | Untreated Control |
|---|---|---|
| % Area Shrinkage after 1 hr washing | 1.4 | 24 |
| % Area Shrinkage after 2 hr washing | 2.8 | 54 |
| % Area Shrinkage after 3 hr washing | 2.8 | 66 |

EXAMPLE 8

| | |
|---|---|
| Resin Formulation: | |
| OLIGAN 3806 (40% concentrate) | 100 ml |
| TERIC GX13 (wetting agent) | 1 g |
| Acrylic Acid (sensitiser) | 10 ml |
| Water | to 1 liter |
| Chemical Pretreatment: | Nil |
| Resin Loading: | 9.3% w/w |
| Irradiation: | Gamma radiation (in air) after resin application and air drying at ambient temperature. |
| Radiation Dose: | $5 \times 10^6$ rad |

| | Treated | Untreated Control |
|---|---|---|
| % Area Shrinkage after 1 hr washing | — | — |
| % Area Shrinkage after 2 hr washing | −1.9 (area increase) | 52 |
| % Area Shrinkage after 3 hr washing | −3.4 (area increase) | 59 |

B. POLYMER RESIN FORMULATIONS BASED ON 'SYNTHAPPRET LKF'

(Bayer Australia Ltd)

This is an aliphatic polyurethane prepolymer with free isocyanate groups, sold as an 80% solution in ethyl acetate or other solvents.

Drying temperatures of 70°–80° C. are recommended by the manufacturer. From the examples it has been found that good shrinkage resistance can be imparted to wool using radiation at ambient temperatures to fix the resin to the wool. Improved results can be obtained by the addition of a small amount of a sensitising agent to the resin solution.

EXAMPLE 9

| | |
|---|---|
| Resin Formulation: | |
| Synthappret LKF (80% solution) | 12.5 g |
| Hydroxy ethyl methacrylate (sensitiser) | 1 ml |
| Trichlorethylene | to 1 liter |
| Chemical Pretreatment: | Nil |
| Resin Loading: | 3.1% w/w |
| Irradiation: | Electron irradiation in air, after resin application |
| Radiation Dose: | $0.2 \times 10^6$ rad |

| | Treated | Untreated Control |
|---|---|---|

-continued

| | | |
|---|---|---|
| % Area Shrinkage after 1 hr washing | 1 | 14 |
| % Area Shrinkage after 2 hr washing | 1 | 49 |
| % Area Shrinkage after 3 hr washing | 2 | 63 |

EXAMPLE 10

| | |
|---|---|
| Resin Formulation: | |
| Synthappret LKF (80% solution) | 25 g |
| Trichloroethylene | to 1 liter |
| Chemical Pretreatment: | Nil |
| Resin Loading: | 5.0% w/w |
| Irradiation: | Electron irradiation in air, after resin application |
| Radiation Dose: | $0.5 \times 10^6$ rad |

| | Treated | Untreated Control |
|---|---|---|
| % Area Shrinkage after 1 hr washing | 0 | 23 |
| % Area Shrinkage after 2 hr washing | 0.4 | 49 |
| % Area Shrinkage after 3 hr washing | 0.4 | 60 |

C. POLYMER RESIN FORMULATIONS BASED ON 'PRIMAL K-3'

(Rohm and Haas Australia Pty. Ltd)

This is a polyacrylate resin, available as a 46% solids emulsion. Polyacrylate resins of this type are thermosetting, and in conventional practice, catalysts such as ammonium chloride, sulphuric acid or oxalic acid are added to the resin solution and curing is carried out at temperatures around 100°-140° C. In conventional practice, pretreatment of the wool with chemicals may be desirable or even necessary to give good adhesion of these types of resin.

As shown in the examples it has been found that improved resin formulations suitable for ambient temperature radiation treatments which impart good shrinkage resistance to wool can be prepared using PRIMAL K-3 resin, but omitting the catalysts. Further improvements can be obtained by adding a small amount of a sensitising agent to the resin formulation, and by chemical pretreatment of the wool.

EXAMPLE 11

| | |
|---|---|
| Resin Formulation: | |
| PRIMAL K-3 concentrate | 10 ml |
| TERIC GX13 (wetting agent) | 1 g |
| Acrylic Acid (sensitiser) | 10 ml |
| Water | to 1 liter |
| Chemical Pretreatment: | Nil |
| Resin Loading: | 7.4% w/w |
| Irradiation: | Gamma irradiation in air, after resin application and air drying at ambient temperatures. |
| Radiation Dose: | $5 \times 10^6$ rad |

| | Treated | Untreated Control |
|---|---|---|
| % Area Shrinkage after 1 hr washing | 0.5 | 22 |
| % Area Shrinkage after 2 hr washing | 1 | 32 |
| % Area Shrinkage after 3 hr washing | 10 | 57 |

EXAMPLE 12

| | |
|---|---|
| Resin Formulation: | |
| PRIMAL K-3 concentrate | 100 ml |

-continued

| | |
|---|---|
| TERIC GX13 (wetting agent) | 1 g |
| Water | to 1 liter |
| Chemical Pretreatment: | Nil |
| Resin Loading: | 8.7% w/w |
| Irradiation: | Gamma irradiation in nitrogen, after resin application and air drying at ambient temperature |
| Radiation Dose: | $5 \times 10^6$ rad |

| | Treated | Untreated Control |
|---|---|---|
| % Area Shrinkage after 1 hr washing | 2.4 | 24 |
| % Area Shrinkage after 2 hr washing | 4.2 | 46 |
| % Area Shrinkage after 3 hr washing | 6.5 | 63 |

EXAMPLE 13

| | |
|---|---|
| Resin Formulation: | |
| PRIMAL K-3 concentrate | 30 ml |
| TERIC GX13 (wetting agent) | 1 g |
| Acrylic Acid (sensitiser) | 0.75 ml |
| Water | to 1 liter |
| Chemical Pretreatment: | 1% alcoholic KOH |
| Resin Loading: | 1.1% w/w |
| Irradiation: | Gamma irradiation in nitrogen, after resin application and air drying at ambient temperature. |
| Radiation Dose | $0.5 \times 10^6$ rad |

| | Treated | Untreated Control |
|---|---|---|
| % Area Shrinkage after 1 hr washing | 4 | 27 |
| % Area Shrinkage after 2 hr washing | 7 | 46 |
| % Area Shrinkage after 3 hr washing | 11 | 66 |

EXAMPLE 14

| | |
|---|---|
| Resin Formulation: | |
| PRIMAL K-3 concentrate | 60 ml |
| TERIC GX13 (wetting agent) | 1 g |
| Acrylic Acid (sensitiser) | 1.5 ml |
| Water | to 1 liter |
| Chemical Pretreatment: | 1% alcoholic KOH |
| Resin Loading: | 5.7% w/w |
| Irradiation: | Electron irradiation in air, after resin application and air drying at ambient temperatures. |
| Radiation Dose: | $5 \times 10^6$ rad |

| | Treated | Untreated Control |
|---|---|---|
| % Area Shrinkage after 1 hr washing | 0.4 | 20 |
| % Area Shrinkage after 2 hr washing | 1.9 | 52 |
| % Area Shrinkage after 3 hr washing | 2.4 | 67 |

EXAMPLE 15

| | |
|---|---|
| Resin Formulation: | |
| PRIMAL K-3 concentrate | 100 ml |
| TERIC GX13 (wetting agent) | 1 g |
| Acrylic Acid (sensitiser) | 5 ml |
| Water | to 1 liter |
| Chemical Pretreatment: | Nil |
| Resin Loading: | 7.6% |
| Irradiation: | Electron irradiation in air, after resin application and air drying at ambient temperature. |
| Radiation Dose: | $5 \times 10^6$ rad |

Untreated

-continued

| | Treated | Control |
|---|---|---|
| % Area Shrinkage after 1 hr washing | 0.9 | 18 |
| % Area Shrinkage after 2 hr washing | 5.0 | 49 |
| % Area Shrinkage after 3 hr washing | 17 | 67 |

EXAMPLE 16

| | |
|---|---|
| Resin Formulation: | |
| PRIMAL K-3 concentrate | 30 ml |
| TERIC GX13 (wetting agent) | 1 g |
| N-Methylolacrylamide (50% aq) (Sensitiser) | 1.6 ml |
| Water | to 1 liter |
| Chemical Pretreatment: | 1% alcoholic KOH |
| Resin Loading: | 0.8% w/w |
| Irradiation: | Gamma irradiation (in nitrogen), after resin application and air drying at ambient temperature. |
| Radiation Dose: | $0.5 \times 10^6$ rad |

| | Treated | Untreated Control |
|---|---|---|
| % Area Shrinkage after 1 hr washing | 5 | 21 |
| % Area Shrinkage after 2 hr washing | 8 | 52 |
| % Area Shrinkage after 3 hr washing | 14 | 65 |

EXAMPLE 17

| | |
|---|---|
| Resin Formulation: As for Example 13 | |
| Chemical Pretreatment: | 1% alcoholic KOH |
| Resin Loading: | 1.0% w/w |
| Irradiation: | Gamma irradiation in nitrogen, followed by treatment with resin (in air) |
| Radiation Dose: | $0.5 \times 10^6$ rad |

| | Treated | Untreated Control |
|---|---|---|
| % Area Shrinkage after 1 hr washing | 3 | 29 |
| % Area Shrinkage after 2 hr washing | 9 | 62 |
| % Area Shrinkage after 3 hr washing | 16 | 67 |

D. POLYMER RESIN FORMULATIONS BASED ON "HERCOSETT" RESINS (Hercules Incorp., Wilmington, Del.—A. C. Hatrick Chemicals Pty. Ltd., Australia)

These are water soluble polyamide-epichlorhydrin resins available as aqueous solutions with 10%–12.5% solids. Current processes for shrink-proofing wool textiles with these resins commonly involve pretreatment of the wool with chlorine compounds and drying/curing temperatures around 90°–100° C.

As shown in the examples it has been found that irradiation at ambient temperature can be used to fix the resin to the wool, imparting good shrinkage resistance to it. In experimental work with the standard test cloth, the best results were obtained when the wool was given a chemical treatment before application of the resin (as in conventional practice). However, as shown in examples, it was found that a reasonable degree of shrinkage resistance with this test cloth could be obtained without a chemical pretreatment step, by using the preirradiation technique, that is first irradiating the wool, then treating it with resin solution.

EXAMPLE 18

| | |
|---|---|
| Resin Formulation: | |
| HERCOSETT 125 (12.5% solution) | 120 ml |
| TERIC GX13 (wetting agent) | 1 g |
| Water | to 1 liter |
| Chemical Pretreatment: | 1% alcoholic KOH |
| Resin Loading: | 1.1% w/w |
| Irradiation: | Gamma irradiation (in nitrogen) after resin application and air drying at ambient temperature. |
| Radiation Dose: | $5 \times 10^6$ rad |

| | Treated | Untreated Control |
|---|---|---|
| % Area Shrinkage after 1 hr washing | 0.9 | 28 |
| % Area Shrinkage after 2 hr washing | 2.3 | 60 |
| % Area Shrinkage after 3 hr washing | 2.7 | 69 |

EXAMPLE 19

| | |
|---|---|
| Resin Formulation: | |
| HERCOSETT 125 (12.5% solution) | 120 ml |
| TERIC GX13 (wetting agent) | 1 g |
| Hydroxyethylmethacrylate (sensitiser) | 3 ml |
| Water | to 1 liter |
| Chemical Pretreatment: | 1% alcoholic KOH |
| Resin Loading: | 1.4% w/w |
| Irradiation: | Gamma irradiation (in nitrogen) after resin application and air drying at ambient temperature |
| Radiation Dose: | $5 \times 10^6$ rad |

| | Treated | Untreated Control |
|---|---|---|
| % Area Shrinkage after 1 hr washing | 0.5 | 27 |
| % Area Shrinkage after 2 hr washing | 1.9 | 63 |
| % Area Shrinkage after 3 hr washing | 1.9 | 71 |

EXAMPLE 20

| | |
|---|---|
| Resin Formulation: | |
| HERCOSETT 125 (12.5% solution) | 120 ml |
| TERIC GX13 (wetting agent) | 1 g |
| Acrylamide (sensitiser) | 3 g |
| Water | to 1 liter |
| Chemical Pretreatment: | 1% alcoholic KOH |
| Resin Loading: | 3.2 w/w |
| Irradiation: | Gamma irradiation (in nitrogen), after resin application and air drying at ambient temperature |
| Radiation Dose: | $5 \times 10^6$ rad |

| | Treated | Untreated Control |
|---|---|---|
| % Area Shrinkage after 1 hr washing | 0.4 | 28 |
| % Area Shrinkage after 2 hr washing | 1.0 | 60 |
| % Area Shrinkage after 3 hr washing | 1.4 | 69 |

EXAMPLE 21

| | |
|---|---|
| Resin Formulation: | |
| HERCOSETT 125 (12.5% solution) | 120 ml |
| TERIC GX13 (wetting agent) | 1 g |
| N-Methylolacrylamide | |

-continued

| | |
|---|---|
| (50% aq. solution) (Sensitiser) | 1.6 ml |
| Water | to 1 liter |
| Chemical Pretreatment: | Nil |
| Resin Loading: | 6.1% w/w |
| Irradiation: | Gamma irradiation (in nitrogen), followed by treatment with resin solution and air drying at ambient temperature |
| Radiation Dose: | $5 \times 10^6$ rad |

| | Treated | Untreated Control |
|---|---|---|
| % Area Shrinkage after 1 hr washing | 6.0 | 21 |
| % Area Shrinkage after 2 hr washing | 18 | 47 |
| % Area Shrinkage after 3 hr washing | 42 | 64 |

EXAMPLE 22

| | |
|---|---|
| Resin Formulation: | |
| HERCOSETT 57 (10% solution) | 200 ml |
| TERIC GX13 (wetting agent) | 1 g |
| Hydroxyethylmethacrylate (Sensitiser) | 2 ml |
| Water | to 1 liter |
| Chemical Pretreatment: | 1% alcoholic KOH |
| Resin Loading: | 5.1% |
| Irradiation: | Electron irradiation (in air) after resin application and air drying at ambient temperature |
| Radiation Dose: | $1 \times 10^6$ rad |

| | Treated | Untreated Control |
|---|---|---|
| % Area Shrinkage after 1 hr washing | 1 | 8 |
| % Area Shrinkage after 2 hr washing | 1 | 39 |
| % Area Shrinkage after 3 hr washing | 1 | 65 |

EXAMPLE 23

| | |
|---|---|
| Resin Formulation: | |
| As for Example 22 | |
| Chemical Pretreatment: | 1% alcoholic KOH |
| Resin Loading: | 5.2% |
| Irradiation: | Electron irradiation in air, following resin application, with specimen still wet with resin solution |
| Radiation Dose: | $1 \times 10^6$ rad |

| | Treated | Untreated Control |
|---|---|---|
| % Area Shrinkage after 1 hr washing | 2 | 8 |
| % Area Shrinkage after 2 hr washing | 4 | 39 |
| % Area Shrinkage after 3 hr washing | 6 | 65 |

EXAMPLE 24

| | |
|---|---|
| Resin Formulation: | |
| HERCOSETT 125 (12.5% solution) | 240 ml |
| TERIC GX13 (wetting agent) | 1 g |
| Hydroxyethylmethacrylate (Sensitiser) | 1.5 ml |
| Water | to 1 liter |
| Chemical Pretreatment: | 1% alcoholic KOH |
| Resin Loading: | 7.4% w/w |
| Irradiation: | Electron irradiation in air, after resin application and air drying at ambient temperature. |
| Radiation Dose: | $5 \times 10^6$ rad |

-continued

| | Treated | Control |
|---|---|---|
| % Area Shrinkage after 1 hr washing | 3.3 | 31 |
| % Area Shrinkage after 2 hr washing | 3.3 | 61 |
| % Area Shrinkage after 3 hr washing | 3.8 | 71 |

EXAMPLE 25

| | |
|---|---|
| Resin Formulation: | |
| HERCOSETT 57 (10% solution) | 240 ml |
| TERIC GX13 (wetting agent) | 1 g |
| Hydroxyethylmethacrylate (Sensitiser) | 3 ml |
| Water | to 1 liter |
| Chemical Pretreatment: | Nil |
| Resin Loading: | 7.3% w/w |
| Irradiation: | Electron irradiation in air, of specimen (with normal moisture regain), followed by treatment with resin solution and air drying at ambient temperature |
| Radiation Dose: | $2.5 \times 10^6$ rad |

| | Treated | Untreated Control |
|---|---|---|
| % Area Shrinkage after 1 hr washing | 2 | 8 |
| % Area Shrinkage after 2 hr washing | 3 | 39 |
| % Area Shrinkage after 3 hr washing | 10 | 65 |

EXAMPLE 26

| | |
|---|---|
| Resin Formulation: | |
| As for Example 24 | |
| Chemical Pretreatment | Nil |
| Resin Loading: | 6.1% w/w |
| Irradiation: | Electron irradiation (in air), of specimen saturated with water, followed by treatment with resin and air drying at ambient temperature |
| Radiation Dose: | $5 \times 10^6$ rad |

| | Treated | Untreated Control |
|---|---|---|
| % Area Shrinkage after 1 hr washing | 3.8 | 26 |
| % Area Shrinkage after 2 hr washing | 7.8 | 55 |
| % Area Shrinkage after 3 hr washing | 24 | 67 |

E. POLYMER FORMULATIONS BASED ON 'DC109' SILICONE RESIN (Dow Corning Australia Pty. Ltd)

DC109 resin is a viscous liquid, believed to be a dimethyl siloxane polymer, end-blocked with hydroxyl groups. The manufacturer's directions for use require the addition of a catalyst, and it is claimed that no heat cure is necessary, if the treated wool materials are allowed to stand for 24–48 hours. In the present work it was found that unlike the four previously mentioned textile resins (Sections A–D), which are not by themselves (i.e. without a sensitising agent) amenable to curing/insolubilisation by radiation, DC109 resin (with no catalyst) can be converted into a solid, elastic material by radiation. Doses around $10^7$ rad (in nitrogen) are required for this radiation gelation effect.

Despite this intrinsic sensitivity of DC109 resin to radiation, it was found that treatment of wool with various formulations based on DC109 (with and without sensitisers) and the use of radiation, did not confer good shrinkage resistance unless high resin loadings and high radiation doses in an inert atmosphere were used.

This illustrates the unexpected nature of the good shrinkage resistance results obtained by using low dose radiation treatments in conjunction with the other types of resin normally requiring thermal/catalytic curing as described in Section A–D.

EXAMPLE 27

| | |
|---|---|
| Resin Formulation: | |
| DC109 Resin | 36 g |
| Hydroxyethylmethacrylate (Sensitiser) | 3.6 ml |
| Trichlorethylene | to 1 liter |
| Chemical Pretreatment: | Nil |
| Resin Loading: | 10.0% w/w |
| Irradiation: | Electron irradiation in nitrogen after resin application |
| Radiation Dose: | $10^7$ rad |

| | Treated | Untreated Control |
|---|---|---|
| % Area Shrinkage after 1 hr washing | 0 | 24 |
| % Area Shrinkage after 2 hr washing | 1 | 53 |
| % Area Shrinkage after 3 hr washing | 1 | 66 |

EXAMPLE 28

| | |
|---|---|
| Resin Formulation: | |
| DC109 Resin | 36 g |
| Trichlorethylene | 1 liter |
| Chemical Pretreatment: | Nil |
| Resin Loading: | 7.8% |
| Irradiation: | Gamma radiation (in nitrogen), after resin application |
| Radiation Dose: | $5 \times 10^6$ rad |

| | Treated | Untreated Control normal values* |
|---|---|---|
| % Area Shrinkage after 1 hr washing | 15 | 24 |
| % Area Shrinkage after 2 hr washing | 17 | 53 |
| % Area Shrinkage after 3 hr washing | 25 | 66 |

*Control included in wash with silicone-treated specimens tended to give lower shrinkage results than normal, due to transfer of silicone material onto control speciments in the wash.

F. POLYMER FORMULATIONS BASED ON SYNTHAPPRET 4694

(Bayer)

Synthappret 4694 is a water soluble bisulphite adduct of a polyurethane resin. In conventional practice it is commonly used in admixture with other resins, expecially soft acrylics such as ACRAMIN SLN (Bayer) as in the SIROLAN BAP process (CSIRO-BAYER). Curing is effected at elevated temperatures.

As shown in the examples the irradiation techniques coupled with the simple laboratory method of applying Synthappret 4694 to the test fabric, did not give good shrink-proofing. Improved results were obtained when the Synthappret 4694 was mixed with other textile resins.

EXAMPLE 29

| | |
|---|---|
| Resin Formulation: | |
| SYNTHAPPRET 4964 (approx. 50% solids) | 70 g |
| TERIC GX13 | |

-continued

| | |
|---|---|
| (wetting agent) | 1 g |
| Water | to 1 liter |
| Chemical Pretreatment: | Nil |
| Resin Loading: | 7.1% |
| Irradiation: | Electron irradiation in nitrogen atmosphere, after resin application and air drying at ambient temperature. |
| Radiation Dose: | $5 \times 10^6$ rad |

| | Treated | Untreated Control |
|---|---|---|
| % Area Shrinkage after 1 hr washing | 23 | 25 |
| % Area Shrinkage after 2 hr washing | 54 | 57 |
| % Area Shrinkage after 3 hr washing | 67 | 70 |

EXAMPLE 30

| | |
|---|---|
| Resin Formulation: | |
| SYNTHAPPRET 4694 (approx. 50% solids) | 30 ml |
| Acramin SLN (approx. 50% solids) | 30 ml |
| Sodium Bicarbonate | 1.5 g |
| Water | to 1 liter |
| Chemical Pretreatment: | Nil |
| Resin Loading: | 6.9% |
| Irradiation: | Gamma irradiation in nitrogen atmosphere, after resin application and air drying at ambient temperature |
| Radiation Dose: | $5 \times 10^6$ rad |

| | Treated | Untreated Control |
|---|---|---|
| % Area Shrinkage after 1 hr washing | 4 | 16 |
| % Area Shrinkage after 2 hr washing | 11 | 38 |
| % Area Shrinkage after 3 hr washing | 26 | 60 |

EXAMPLE 31

| | |
|---|---|
| Resin Formulation: | |
| SYNTHAPPRET 4694 (approx. 50% solids) | 30 ml |
| OLIGAN 3806 (40% concentrate) | 30 ml |
| Water | to 1 liter |
| Chemical Pretreatment: | Nil |
| Resin Loading: | 8.8% |
| Irradiation: | Electron irradiation in air, after resin application and air drying at ambient temperature |
| Radiation Dose: | $5 \times 10^6$ rad |

| | Treated | Untreated Control |
|---|---|---|
| % Area Shrinkage after 1 hr washing | 6 | 28 |
| % Area Shrinkage after 2 hr washing | 24 | 58 |
| % Area Shrinkage after 3 hr washing | 49 | 70 |

What is claimed is:

1. A method of treating a wool textile for imparting shrink-resistant properties which comprises applying to the textile a dose of up to 10 megarads of ionizing radiation and a thin application of a textile polymer resin, said textile polymer resin being a resin which in vitro is not cured by said dose of up to 10 megarads of ionizing radiation but is cured by said ionizing radiation in the presence of the wool fibers of the wool textile whereby a shrink-resistant property is imparted to the wool textile, the process being carried out substantially at ambient temperature.

2. A method according to claim 1, wherein the first step comprises subjecting the wool textile to ionizing radiation and a second step comprises applying the polymer resin to the wool textile in the absence of catalysts.

3. A method according to claim 1, wherein the first step is the application of the polymer resin to the wool textile in the absence of catalysts and a second step comprises irradiating the wool textile with the ionising radiation.

4. A method according to claim 1, wherein the polymer resin has a low glass transition temperature and a low free surface energy.

5. A method according to claim 1, wherein the polymer resin is selected from the group consisting of:

(i) aqueous dispersions or emulsions of polymers prepared from acrylic or methacrylic monomers;

(ii) aqueous solutions of resins prepared by reacting polyamide resins with epichlorhydrin;

(iii) aqueous dispersions or emulsions of thiol terminated polyether resins;

(iv) organic solvent solutions of polyurethane resins containing free isocyanate groups;

(v) aqueous solutions of polyurethane resins containing isocyanate groups which have been masked by the formation of bisulphite adducts; and (vi) organic solvent solutions of polysiloxane polymers.

6. A method according to claim 1, wherein the dose of ionising radiation is in the range $5\times10^4$ to $10^7$ rads.

7. A method according to claim 1, wherein the quantity of polymer resin is in the range 0.5% to 10% of the weight of the wool textile.

8. A method according to claim 5, wherein said polymer resin comprises a mixture of two or more of the group of polymer resins defined in claim 6.

9. A method according to claim 1 wherein a radiation sensitising agent is included with the polymer resin.

10. A method according to claim 9, wherein the sensitising agent is selected from the group consisting of acrylic acid, acrylamide, N-methylolacrylamide, hydroxyethylmethacrylate, acrylonitrile, ethyl acrylate, glycol dimethacrylate, 2-ethoxyethylmethacrylate, vinyl acetate, divinyl benzene, trimethylolpropane trimethacrylate, low molecular weight polydimethyl siloxanes, low molecular weight unsaturated polyurethane compounds and low molecular weight polythioether compounds.

* * * * *